United States Patent [19]

Cramer et al.

[11] 4,390,346

[45] Jun. 28, 1983

[54] APPARATUS FOR MIXING AT LEAST ONE ADDITIONAL GAS INTO A MAIN FLOW OF GAS

[75] Inventors: Rudolph E. Cramer, Oudkarspel; Johannes H. W. Ouwerkerk, Driehuis, both of Netherlands

[73] Assignee: Hoogovens Ijmuiden B.V., Netherlands

[21] Appl. No.: 305,200

[22] Filed: Sep. 24, 1981

Related U.S. Application Data

[63] Continuation of Ser. No. 145,744, May 1, 1980, abandoned.

[30] Foreign Application Priority Data

May 11, 1979 [NL] Netherlands ..... 7903708

[51] Int. Cl.[3] ..... B01F 3/02

[52] U.S. Cl. ..... 48/180 R; 48/180 F; 137/896

[58] Field of Search ..... 48/180 C, 180 R, 180 S, 48/180 M, 180 F; 431/354; 366/341; 261/79 A; 137/896

[56] References Cited

U.S. PATENT DOCUMENTS

| | | | |
|---|---|---|---|
| 571,196 | 10/1896 | Kirkwood | 48/180 C |
| 1,543,942 | 6/1923 | Mathesius | 261/79 A |
| 3,207,484 | 9/1965 | Rubin | 366/336 |
| 3,391,908 | 7/1968 | MacDonald | 366/101 |
| 4,033,714 | 7/1977 | Longworth | 48/180 F |

FOREIGN PATENT DOCUMENTS

| | | |
|---|---|---|
| 1301800 | 8/1969 | Fed. Rep. of Germany . |
| 2155188 | 6/1972 | Fed. Rep. of Germany . |
| 2222124 | 10/1974 | France . |

*Primary Examiner*—William F. Smith

*Attorney, Agent, or Firm*—Stevens, Davis, Miller & Mosher

[57] ABSTRACT

Gas is mixed into a main flow of gas in a cylindrical conduit by means of one or more feed conduits. In order to achieve good mixing and avoid concentrations of the added gas, the feed conduit(s) have two openings for outflow of the added gas, which openings are spaced from the wall of the cylindrical conduit, are symmetrically located with respect to the axis of the cylindrical conduit and lie in a plane perpendicular to that axis. The axis of these openings are mutually spaced by less than one half of the internal diameter of the conduit. The added gas emerges from the two openings in mutually opposite parallel directions, so that it tends to circulate around the axis. The arrangement has been found advantageous when applied to the feed of gaseous fuel to hot blast stoves of a blast furnace.

7 Claims, 2 Drawing Figures

APPARATUS FOR MIXING AT LEAST ONE ADDITIONAL GAS INTO A MAIN FLOW OF GAS

This is a continuation of application Ser. No. 145,744 filed May 1, 1980 now abandoned.

BACKGROUND OF THE INVENTION

1. Field of the Invention

The invention relates to apparatus for mixing at least one additional gas into a main flow of a gas flowing in a cylindrical conduit.

2. Description of the Prior Art

Mixing apparatus for gases, apart from burners, can be subdivided into two types, i.e. flow mixers and rotating mixers; the invention is concerned with flow mixers and more specifically with centrifugal mixers, in which whereby one or more lines for the gas to be admixed debouch tangentially into the cylindrical main conduit. Existing gas mixers have the disadvantage, however, that the mixing must take place over an excessively long section of the main conduit, because of the requirements of controlling noise (a shorter mixing path can be achieved by increasing the prepressure of the injected gas to above-critical value, which results in supersonic inflow velocities and the noise associated therewith).

In particular if two gaseous fuels of different combustion values are to be mixed, before being burnt in a burner, the mixing should be completed over a short distance (10 D where D is the conduit diameter), since otherwise the burner will burn irregularly and even pulsatingly. Also if control of the calorific-value of the fuel gas is attempted, long travel times from the mixer to the burner, must be avoided, in view of the instability of the control and therefore aforesaid burner problems.

SUMMARY OF THE INVENTION

The invention therefore has the object of providing mixing apparatus for gases which enables a gas to be added into and mixed with a main flow over a short distance of the main flow and without packets of unmixed or partially mixed gas remaining.

According to the invention, for the introduction of the additional gas or gases into the main flow, there are provided two openings from said feed conduit or conduits, which openings are spaced from the wall of the cylindrical conduit, are arranged symmetrically with respect to the axis of the cylindrical conduit and in a plane perpendicular to said axis, the axes of the openings being spaced from each other by less than one half of the internal diameter of the cylindrical conduit and the openings being adapted to direct the additional gas or gases in respective parallel directions with respect to said axis, said parallel directions being mutually opposite as seen in transverse section of the conduit, so that the gas or gases emerging from both openings circulates around the axis in the same direction.

This arrangement has been found to provide good mixing over a shorter distance. When incorporated in a feed to a burner, it allow a calm non-pulsating flame to be obtained, because energy-rich packets of gas are not produced. The two openings for the added gas or gases, which are supplied at an over-pressure relative to the main flow, produce circulating flow around the axis of the main flow conduit, which rapidly achieves good mixing.

The openings should be spaced from the wall of the cylindrical conduit and the axes are preferably mutually spaced apart by about one-third of the diameter of the cylindrical conduit.

There may be two feed conduits to the respective openings, supplying the same gas or different gases, or there may be a single feed conduit having both the openings.

BRIEF INTRODUCTION OF THE DRAWING

Two embodiments of the invention will now be described by way of example with reference to the accompanying drawing in which.

DESCRIPTION OF THE PREFERRED EMBODIMENTS

Figure 1:
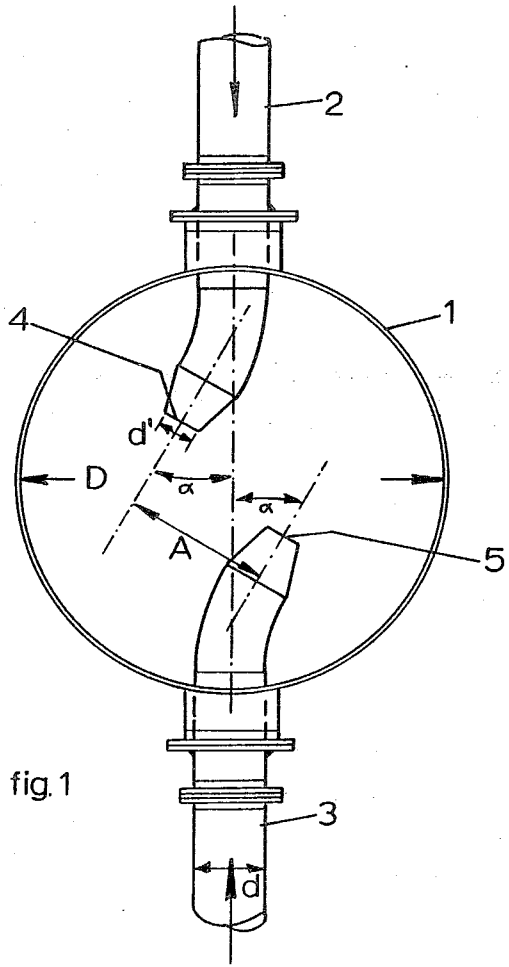
FIG. 1 is a transverse cross-section of the cylindrical main conduit of a first embodiment, in which two separate supply conduits feed the additional gas.

Referring to FIG. 1, the main conduit 1 is shown with an internal diameter D in cross-section. Two feed conduits 2,3 connected radially through the wall of the main conduit 1 are disposed diametrically opposite each other; their internal diameter is d. At their ends in the conduit 1 both feed conduits 2,3 have openings 4,5 for the discharge of the additional gas and within the conduit 1 are bent or curved over an angle $\alpha$. The diameter of the openings 4,5 is designated d'. The center lines of the openings 4,5 thus extend parallel and in fact have a spacing A.

It can be seen from FIG. 1 that the openings 4,5 are symmetrically disposed with respect to the axis of the conduit 1 and lie in a common plane perpendicular to that axis. The directions of discharge of gas through the openings 4,5 are opposed and are both approximately tangential, i.e. such as to cause circulation of gas around the axis.

In one particular construction used in practice, D is 1800 mm; d is 324 mm; d' is 252 mm; $\alpha$ is 30° and A is 600 mm. Through the main line, blast furnace gas was fed along the main conduit 1 and coke oven gas through the feed conduits 2,3 in a controllable ratio.

Figure 2:
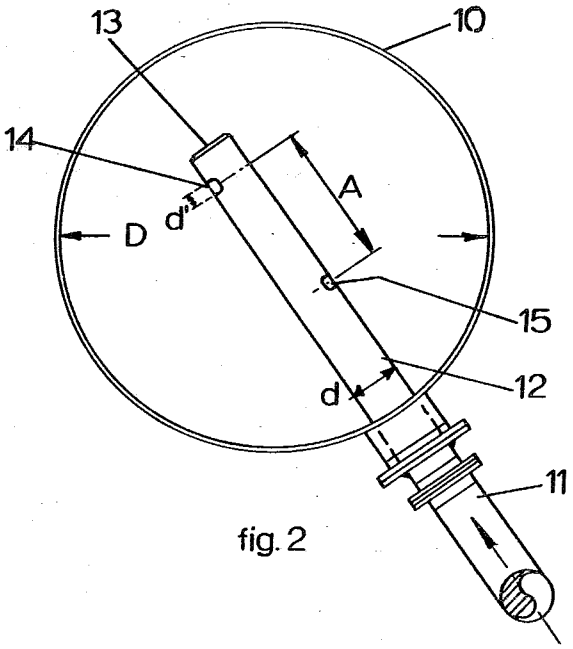
FIG. 2 is a transverse cross-section of the cylindrical main line conduit of a second embodiment in which only one feed conduit opens into the main conduit.

FIG. 2 shows a still more simple construction of a gas mixing apparatus according to the invention wherein only one feed conduit 11 projects radially through the wall of the cylindrical main conduit 10. The main conduit 10 has an internal diameter D. The feed conduit 10 has an internal diameter d and its portion 12 in the main conduit is straight. This portion 12 is closed at its end 13 within the conduit 1. In the plane perpendicular to the axis of the conduit 1 i.e., in the plane of the drawing, are two openings or apertures 14 and 15 having a diameter d' respectively on opposite sides of the portion 12 and having a mutual spacing A from each other.

In a construction used in practice D is 1820 mm; d is 219 mm; d' is 90 mm; A is 600 mm. Through the main line flowed blast furnace gas and through the feed line natural gas.

In both these embodiments, the calorie-richer gas was injected at an over-pressure of at least 50 mm water column into the main flow which had a pressure of approximately 300 to 400 mm water column. Even at an over-pressure of 5000 mm water column, this results—in dependence on the relative density of the gas—in an injection velocity of 200 to 250 m/sec, i.e. still subsonic.

The control range for the injection point is determined by the square root of the ratio of the largest and smallest over-pressure (thus, using the figures given above), this range is $$\sqrt{\frac{5000 + 300}{50 + 300}} = 3.9).$$

For a desired larger control range more injection points are correspondingly necessary.

In the arrangement of the invention, the introduced gas is introduced not along the wall of the main conduit but into the gas stream itself, and tangentially. Thereby, there arises a rotating movement of the gas in the cylindrical main conduit, on the gas flowing through the main line and is deflected therein.

The diameter d' required for the outflow apertures is a function of the over-pressure and of the mixture ratio. The diameter d of the feed conduit 12 has, in the case of FIG. 2, is related to the diameter d' of the apertures 14 or 15 so that the cross-sectional area of the conduit 12 is at least three times the sum of the surface area of the apertures 14 and 15. From this requirement it results that d must be $\geqq 2.5$ d'.

Compared with the conventional method using inflow of the added gas at the periphery, as in the case of a cyclone mixer, the length of the main conduit over which mixing occurs in the gas mixing apparatus according to the invention may be only one half.

As already stated, the gas mixing apparatus according to the invention can be applied with success to the mixing of coke oven gas or natural gas into a main flow of poor blast furnace gas. Such a mixture of enriched blast furnace gas is then fed as fuel to the burner of a hot blast stove. Because of the low intrinsic frequency of the combustion chamber of a hot blast stove, the burner of the stove must not pulsate. See in this connection the article "Investigation of pulsating gas combustion in blast-furnace hot-blast stoves" in the English version of "Steel in the USSR", 294–295 of Stal', 1976 (6), 498–500. It has been found that, with the use a gas mixer according to the invention in the main gas conduit, the occurrence of energy-richer gas packets belongs to the past. Thus, at a distance of 10 D downstream from the gas mixing point, a gas-sampling point is located in the main conduit; the results of the sampling are used for adjustment of the mixing ratio. The mixing delay time is the time elapsing between the determination of the mixture ratio at the distance 10 D from the mixer and the consequent adjustment of the valve in the feed line for correction of the ratio. If the mixing is not good, the result can be oscillation and "overshooting".

The invention is not limited to this application, it can with equal success be used for the injection of natural gas into blast furnace gas employed in a power station and for the injection of pure oxygen into a blast main of the hot blast stoves, on the side towards a blast furnace. In this latter case, the mixing apparatus ensures that the risk of a high oxygen concentration at the conduit wall is minimized or avoided entirely.

The gas mixer according to the invention can be called semi-tangential injection. Without excessive pulsation, gas may be admixed with minimum pressure differences and without excessive pulsation. At the same time, quick agitation and mixing takes place. Since no partitions, propellers and the like are employed, the pressure loss in the main flow is negligibly small.

What is claimed is:

1. Apparatus for mixing at least one additional gas into a main flow of gas, consisting of a cylindrical conduit having a flow passage and a wall bounding the flow passage to carry said main flow and two feed conduits in a single plane initially extending radially and opening into the cylindrical conduit with each having one opening therein, for the introduction of the said additional gas into the said main flow, the two openings of said conduits being spaced from the wall of the cylindrical conduit and arranged symmetrically with respect to the axis along the length of the cylindrical conduit and in said plane, said plane being perpendicular to said axis, the axes of the said openings being spaced apart from each other by less than one half of the internal diameter of the cylindrical conduit and the said openings being adapted to direct the additional gas in respective opposite parallel directions, so that the gas emerging from both openings tends to circulate in the same direction around the axis of the cylindrical conduit.

2. Apparatus for mixing at least one additional gas into a main flow of gas, consisting of a cylindrical conduit having a flow passage and a wall bounding the flow passage to carry said main flow and one feed conduit extending radially and opening into the cylindrical conduit with two openings therein, for the introduction of the said additional gas into the said main flow, said two openings being spaced from the wall of the cylindrical conduit and arranged symmetrically with respect to the axis along the length of the cylindrical conduit and in a plane perpendicular to said axis, the axes of the said openings being spaced apart from each other by less than one half of the internal diameter of the cylindrical conduit and the said openings being adapted to direct the additional gas in respective opposite parallel directions, so that the gas emerging from both openings tends to circulate in the same direction around the axis of the cylindrical conduit.

3. Apparatus according to claim 1 wherein said two feed conduits each of which has an inner end, are curved in the said plane within the cylindrical conduit and have one opening located at each inner end, the said openings respectively having center axes which have the said mutual spacing.

4. Apparatus according to claim 3 wherein each of said feed conduits are curved in the said plane within the cylindrical conduit through an angle of about 30° with respect to the axis along the length of said feed conduit.

5. Apparatus according to claim 2 wherein said feed conduit is straight and projects radially across the cylindrical conduit and has a closed end within the conduit, the said two openings being provided in the said feed conduit at opposite sides thereof.

6. Apparatus according to claim 1 or claim 2 wherein the said openings are generally circular, and the internal diameter of the feed conduit is at least 2.5 times the diameter of each said opening.

7. Apparatus according to one of claims 3 or 5 wherein the mutual spacing of the axes of said two openings is about one-third of the internal diameter of the cylindrical conduit.

* * * * *